United States Patent [19]

Larsson et al.

[11] Patent Number: 4,691,616

[45] Date of Patent: Sep. 8, 1987

[54] ARRANGEMENT FOR FIRE CONTROL

[75] Inventors: Klas G. I. Larsson, Järfälla; Rolf C. Lindholm, Upplands Väsby; Johan P. Ström, Järfälla, all of Sweden

[73] Assignee: U.S. Philips Corporation, New York, N.Y.

[21] Appl. No.: 821,565

[22] Filed: Jan. 22, 1986

[30] Foreign Application Priority Data

Jan. 25, 1985 [SE] Sweden ..... 8500360

[51] Int. Cl.[4] ..... F41G 1/04

[52] U.S. Cl. ..... 89/41.07; 89/41.17

[58] Field of Search ..... 89/41.05, 41.07, 41.17; 343/5 ST, 7 G; 342/66, 67, 70

[56] References Cited

U.S. PATENT DOCUMENTS

| | | | |
|---|---|---|---|
| 2,968,997 | 1/1961 | Newton et al. | 89/41.07 |
| 3,258,595 | 6/1966 | Galante | 89/41.05 |
| 3,925,783 | 12/1975 | Bleday et al. | 343/872 |
| 4,024,318 | 5/1977 | Forster et al. | 428/457 |
| 4,131,438 | 12/1978 | Debrotnic | 137/181 |
| 4,155,970 | 5/1979 | Cassell | 264/317 |

*Primary Examiner*—Stephen C. Bentley
*Assistant Examiner*—Stephen M. Johnson
*Attorney, Agent, or Firm*—Thomas A. Briody; Jack Oisher; William J. Streeter

[57] ABSTRACT

The invention relates to a tracking radar (17) rigidly connected to the fire tube (11) of a gun and controlling the set motors (14) of the gun in order to, after locking onto a target, cause the radar axis and thereby the axis of the fire tube (11) to follow the target. The invention the tracking radar (17) is contained in a protection envelope (20) which is fixedly mounted on the elevation system (12) of the gun and which at the front end in the fire direction is closed by a radome (21). The protection envelope (20) and radome (21) are dimensioned so as to withstand the forces arising at fire, in particular to prevent the compression waves then arising from deforming the antenna of the radar (17). The accuracy of the radar will thus be substantially maintained during firing of the gun.

4 Claims, 4 Drawing Figures

ARRANGEMENT FOR FIRE CONTROL

BACKGROUND OF THE INVENTION

1. Field of the Invention

The invention relates to an arrangement for fire control of a gun, comprising a tracking radar unit with radar transmitter/receiver and antenna means, mounted directly on the gun so that the axis of the antenna means forms a given angle with the axis of the fire tube, and producing control signals for the set motors of the fire tube in order to, after locking on a target, bring the radar axis and thereby the axis of the fire tube to follow the target by influencing the said set motors in a closed servo loop.

2. Description of the Invention

By mounting the tracking radar unit directly on the gun an improved all-weather-capability of gun fire control is achieved. However, there is a mechanical influence on the radar at firing, caused by compression waves from the mouth of the fire tube, recoil and damping forces. This produces a mechanical environment with large accelerations over a wide frequency range.

In a previously proposed system, in which the tracking radar is included in the servo loop of the gun, the gun is directed to a predicted forward point at the firing moment. There is then no requirement for simultaneous radar tracking and firing, but this requires that the compression waves at fire do not influence the radar during the tracking phase.

However, in certain applications it is advantageous to utilize the tracking radar also during fire. It should furthermore withstand the operative environment, involving the influences of vibration, ice, snow, rain, sand, flushing water and sun irradiation.

Under all these conditions it should maintain high accuracy and large operating range, and furthermore have multi-target (MTI) tracking capability.

A further objective is that it should be difficult to discover the radar by detection of IR-radiation.

It is assumed that the firing tube and the radar axis are parallel or have predictable static and dynamic deviations. Any such deviation which is unknown produces an error contribution from the radar.

The error contribution of the radar can be described in terms of its resolution and accuracy.

By resolution is meant the ability of the radar to discriminate between two adjacent targets. The resolution ability is measured laterally and in range. The lateral resolution is substantially the same as the lobe angle in the horizontal plane. The range resolution is a function of the radar pulse length.

By accuracy is meant the ability of the radar to determine the position of a target. The accuracy can be better than the resolution. In other words a target can be localized with errors which are smaller than the lobe width and pulse length, respectively.

The accuracy of a radar is to a large extent determined by the radar antenna. A radar antenna which is deformed by compression waves, locally heated by sun irradiation, influenced by ice coating etc, produces erroneous angular information. The determination of the position of the target will then also be erroneous.

SUMMARY OF THE INVENTION

The object of the invention is to achieve an arrangement of the kind described in the opening paragraph, in which the tracking radar substantially maintains its accuracy under the mentioned difficult operation conditions, so that it may also function during fire.

According to the invention this is achieved by supporting the tracking radar unit within an envelope which is rigidly mounted on the elevation system of the gun, the tracking radar unit and the envelope being connected together by means of fastening elements, for example elastically resilient supporting elements, at opposite surfaces of the envelope and the radar unit. The envelope serves as a reference surface for the radar unit, but the radar unit is otherwise is free from the envelope. The front of the envelope is closed by a radome which is dimensioned to withstand the forces arising at fire, in order to prevent deformation of the antenna means and ensure tracking function during firing. The envelope has connections for supply of cooling or heating medium to the space between the envelope with radome and the tracking radar unit.

By means of the invention the tracking radar and radar antenna are protected against compression waves. No deformation of the antenna and no parallel errors between bore sight and radar axis will arise. The protection envelope and radome will also protect against vibration, flushing water and the effects of travel in difficult terrain. Due to the fact that the envelope protects against compression waves it is possible to achieve low vibration conditions for the radar, which increases the available time for MTI-operation.

Preferably the protection envelope with radome is a closed envelope having connections for a flowing heating or cooling medium. Thereby it is easily possible to defrost the radome by means of hot air circulation through the envelope, preventing radar measuring errors due to uneven ice coating. The IR-radiation of the radar can be reduced by means of cool air circulation.

The protection envelope can suitably be made of a plastic material e.g. reinforced with fibres of a material similar to that sold under the trade mark Kevlar, which if desired can be coated with an IR-reflecting surface layer. Also the radome can be made of plastic material reinforced by Kevlar and is made to match the actual frequency band. This will result in a low total weight and thereby low strains on the fastening points on the gun.

By means of the invention the radar antenna will also be protected against sun irradiation preventing radar measuring errors due to such irradiation.

In one embodiment the protection envelope, as seen in a plane perpendicular to the radar axis, has an indentation adapted to enclose and be fastened to a part of the elevation system of the gun having a corresponding section. This gives the protection envelope a higher mechanical rigidity, permitting better fastening of the same with a given material quantity and weight.

BRIEF DESCRIPTION OF THE DRAWINGS

The invention is illustrated by means of example with reference to the accompanying drawings, in which.

DESCRIPTION OF THE PREFERRED EMBODIMENTS

Figure 1:
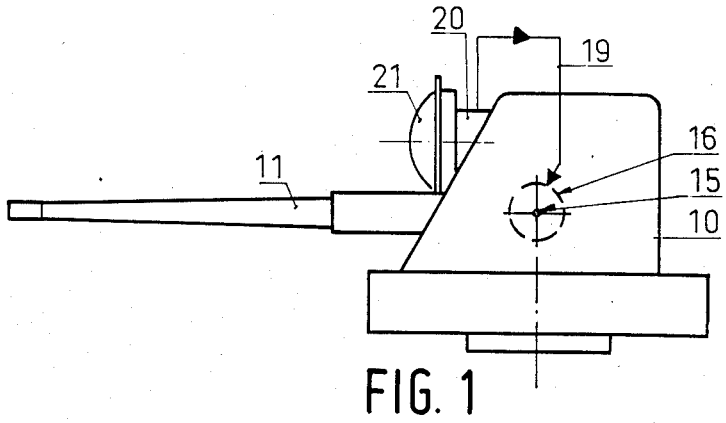
FIGS. 1 and 2 show a simplified side view and a plan view, respectively, of an automatic gun with tracking radar mounted directly on the elevation system of the gun in according with the invention.
Figure 2:
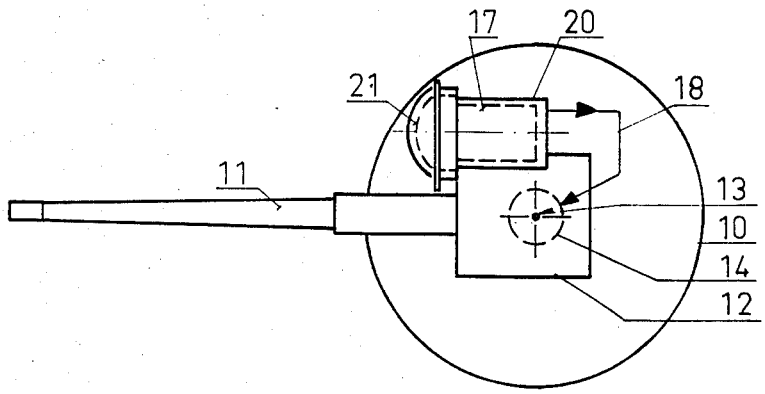
Figure 3:
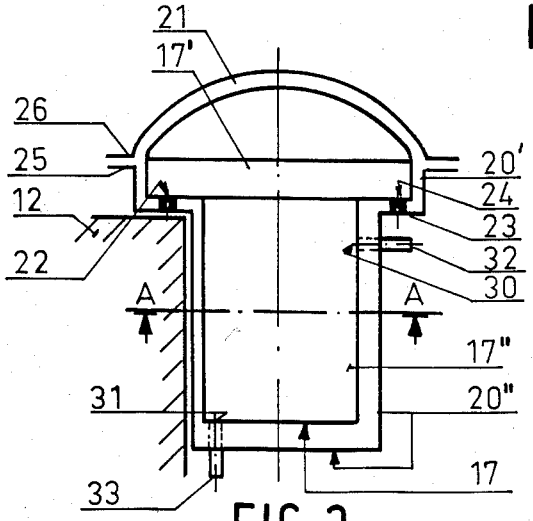
FIG. 3 shows a sectional view through the tracking radar mounted in a protection envelope according to the invention and FIG. 4 shows a sectional view along the line A—A in FIG. 3.

In FIGS. 1 and 2 reference numberal 10 designates a gun tower, 11 is a fire tube and 12 an elevation part. The gun tower 10 is swingable in lateral direction about a vertical axis 13 and is adjusted about the said axis by means of a set motor, which is represented by the circle 14. The fire tube 11 and the part 12 are rigidly mounted together and form together the elevation system of the gun, which system is swingable about a horizontal axis 15. The elevation system is adjusted in height direction about the said axis 15 by means of a set motor, which is represented by a circle 16. A tracking radar 17 is mounted directly on the elevation system of the gun, more specifying on the elevation part 12, and contains a radar transmitter/receiver and radar antenna and signal processing means. The axis of the radar antenna is suitably adjusted to be parallel with the axis of the fire tube. The tracking radar 17 generates control signals for the set motors 14 and 16, as indicated by the conductors 18 and 19, so that closed servo loops are formed in which, after locking onto a target, the radar axis and thereby the axis of the fire tube are kept directed towards the target. According to the invention the tracking radar 17 is mounted within a protection envelope or a cassette 20 which in turn is fixedly mounted on the elevation part 12 of the gun. At the front, i.e. in the fire direction, the cassette is closed by a radome 21. As shown in FIG. 3, the tracking radar 17 has a front part 17', where the radar antenna is situated, which has larger dimensions than the remainder 17'' of the tracking radar so that between the two parts is formed a shoulder 22. The cassette 20 is shaped in corresponding manner and consists of two parts 20', 20'' and an intermediate shoulder 23. After mounting of the tracking radar in the cassette the shoulder 22 on the radar bears against the shoulder 23 on the cassette so that the said last shoulder will form a reference surface for the radar. The radar can be rigidly mounted within the cassette or, as in the shown example, fastened via a resilient damping element 24. At its open front end the cassette is terminated by a fastening flange 25 and the radome has a corresponding flange 26 adapted to be fastened to the said flange on the cassette.

Figure 4:
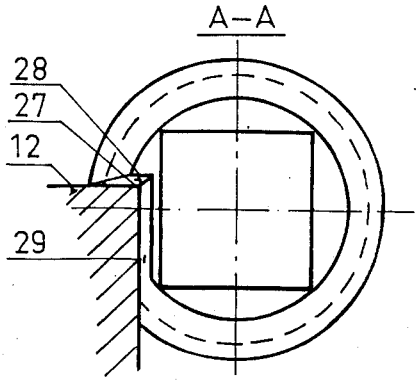

As is evident from FIG. 4 the cassette 20 with tracking radar 17 is mounted on a corner 27 of the elevation part 12 and is for this purpose shaped with an indentation consisting of two mutually perpendicular plane sides 28, 29 which are placed on the part 12 at the said corner 27. This shape of the cassette with an indentation will increase the mechanical rigidity of the cassette and will improve its effective fastening to the elevation system.

In the side walls of the cassette there are two openings 30, 31 with connection tubes 32, 33 adapted to be connected to a source of cooling medium or heating medium.

The cassette as well as the radome may be made of plastic reinforced with Kevlar. In order to reduce the influence of sun irradiation on the radar the cassette can suitably be coated with an IR-reflecting layer.

After mounting the radome on the cassette, the cassette and radome will form a closed envelope. Through this envelope a cooling medium or heating medium can be brought to circulate by connecting the connection tubes to a source for cooling medium or heating medium. The circulation of a cooling medium can be used in order to decrease the IR-radiation and thereby to decrease the possibilities of discovery by means of IR-detectors. Circulation of a heating medium, e.g. heated air, can be used in order to prevent ice coating.

To mount the cassette if is fastened rigidly on the outside of the elevation system by means of screws or in another manner. Thereafter the radar is introduced with its small end part through the open end of the cassette until the shoulder on the radar will bear against the shoulder on the cassette, possibly with intermediate damping element, and is screwed onto the cassette or fixed in another manner. Finally, the radome is placed at the open end of the cassette and the flanges on the cassette and radome are mounted together, e.g. by means of screws. Before mounting the radome on the cassette or after demounting of the radome the radar is easily available for adjustment relative to the fire tube so that the radar axis will be exactly parallel to the axis of the fire tube. For this purpose adjustment screws or the corresponding (not shown) may be present at the fastening place between tracking radar and cassette.

What is claimed is:

1. A fire control system for a gun having a fire tube and an elevation system comprising set motors for setting the horizontal and vertical position of the fire tube, such fire control system comprising a tracking radar unit having a radar transmitter/receiver and an antenna, the tracking radar unit being mounted directly on the gun so that the axis of the antenna forms a given angle with the axis of the fire tube, and producing control signals in a closed servo loop connected to the set motors of the gun so that, after locking on a target, the movement of the axis of the radar unit causes the axis of the fire tube to track the target by controlling the set motors; characterized in that the radar unit is supported within an envelope which is rigidly mounted on the elevation system of the gun, the radar unit being fastened to the envelope by elastically resilient supporting elements at opposite surfaces of the envelope and the radar unit, said envelope being closed at the front by a radome which is dimensioned to withstand the forces arising upon firing of the gun in order to prevent deformation of the antenna and ensure correct target tracking, said protection envelope having apertures therein for connection to a source of thermal fluid medium for controlling the temperature within such envelope.

2. A fire control system as claimed in claim 1 characterized in that the cross-section of the protection envelope, as seen in a plane perpendicular to the axis of the radar unit, has an indentation therein which encloses and is fastened to a part of the elevation system of the gun having a corresponding cross-sectional indentation.

3. A fire control system as claimed in claim 1, characterized in that the protection envelope is made of a reinforced plastic material.

4. A tracking radar unit as claimed in either of claims 1 or 3, characterized in that the protection envelope is coated with an infrared reflecting surface layer.

* * * * *